US012371822B2

(12) United States Patent
Goenka et al.

(10) Patent No.: US 12,371,822 B2
(45) **Date of Patent: *Jul. 29, 2025**

(54) HYGRO TEXTILE STRUCTURES AND RELATED PROCESSES

(71) Applicant: Welspun India Limited, Mumbai (IN)

(72) Inventors: Dipali Goenka, Mumbai (IN); Subrata Palit, Mumbai (IN); Utpal Haldar, Mumbai (IN); Rajender Sharma, Mumbai (IN)

(73) Assignee: Welspun India Limited, Mumbai (IN)

( * ) Notice: Subject to any disclaimer, the term of this patent is extended or adjusted under 35 U.S.C. 154(b) by 1145 days.

This patent is subject to a terminal disclaimer.

(21) Appl. No.: 15/997,937

(22) Filed: Jun. 5, 2018

(65) Prior Publication Data

US 2018/0347077 A1 Dec. 6, 2018

(30) Foreign Application Priority Data

Jun. 6, 2017 (IN) ..... 201721019835

(51) Int. Cl.

| | |
|---|---|
| ***D02G 3/04*** | (2006.01) |
| ***D02G 3/22*** | (2006.01) |
| ***D02G 3/36*** | (2006.01) |
| ***D02G 3/40*** | (2006.01) |

(52) U.S. Cl.

CPC ..... *D02G 3/04* (2013.01); *D02G 3/22* (2013.01); *D02G 3/36* (2013.01); *D02G 3/406* (2013.01); *D10B 2201/02* (2013.01); *D10B 2321/06* (2013.01); *D10B 2401/024* (2013.01)

(58) Field of Classification Search

None

See application file for complete search history.

(56) References Cited

U.S. PATENT DOCUMENTS

| | | | | |
|---|---|---|---|---|
| 3,095,258 A | | 6/1963 | Scott | |
| 3,625,389 A | | 12/1971 | Bartlow | |
| 3,721,272 A | | 3/1973 | Hager | |
| 4,352,380 A | | 10/1982 | Owen et al. | |
| 4,554,121 A | * | 11/1985 | Kramers | D01D 5/08 528/289 |
| 4,941,884 A | | 7/1990 | Green | |
| 6,335,087 B1 | * | 1/2002 | Hourahane | E04C 5/073 428/397 |

(Continued)

FOREIGN PATENT DOCUMENTS

| | | | | |
|---|---|---|---|---|
| CN | 101255618 A | * | 9/2008 | D01F 6/84 |
| JP | 4108131 A | | 4/1992 | |

(Continued)

OTHER PUBLICATIONS

Kathryn L. Hatch, "Chapter 34: Dyed Textiles.", Textile Science, Tailored Text Custom Publishing, 2006, 3 pp.

(Continued)

*Primary Examiner* — Grace Huang

(74) *Attorney, Agent, or Firm* — Offit Kurman; Gregory A. Grissett

(57) ABSTRACT

A woven fabric includes a plurality of warp yarns and a plurality of weft yarns interwoven with the plurality of warp yarns to define the woven fabric. Multiple weft yarns are inserted through the shed during weaving cycle to form higher thread count fabrics.

3 Claims, 9 Drawing Sheets

(56) References Cited

U.S. PATENT DOCUMENTS

| | | | | |
|---|---|---|---|---|
| 6,534,175 | B1 | 3/2003 | Zhu et al. | |
| 6,952,915 | B2 | 10/2005 | Prickett | |
| 7,913,483 | B2 * | 3/2011 | Qiu | D02G 3/367 57/18 |
| 8,733,075 | B2 | 5/2014 | Mandawewala | |
| 8,910,461 | B2 | 12/2014 | Liao | |
| 10,007,347 | B1 | 6/2018 | Khoshkava et al. | |
| 10,196,763 | B2 | 2/2019 | Debnath et al. | |
| 10,538,865 | B2 | 1/2020 | Wang | |
| 10,704,168 | B2 * | 7/2020 | Yenici | D02G 3/44 |
| 10,982,358 | B2 | 4/2021 | Alexander et al. | |
| 2002/0034902 | A1 | 3/2002 | Litton | |
| 2003/0205041 | A1 | 11/2003 | Baker Jr. | |
| 2004/0128811 | A1 | 7/2004 | Mandawewala | |
| 2004/0170836 | A1 | 9/2004 | Bond et al. | |
| 2007/0087162 | A1 | 4/2007 | Mandawewala | |
| 2007/0103668 | A1 | 5/2007 | Xu et al. | |
| 2008/0085648 | A1 | 4/2008 | Hirouse et al. | |
| 2011/0240626 | A1 | 10/2011 | Mullebrouck et al. | |
| 2015/0024202 | A1 | 1/2015 | Smith | |
| 2015/0284881 | A1 | 10/2015 | Yu et al. | |
| 2016/0237596 | A1 | 8/2016 | Weiser | |
| 2016/0273135 | A1 | 9/2016 | Mittal et al. | |
| 2016/0333506 | A1 | 11/2016 | Goenka | |
| 2017/0073858 | A1 | 3/2017 | Goenka | |
| 2017/0175323 | A1 * | 6/2017 | Yu | D06H 7/228 |
| 2018/0105960 | A1 | 4/2018 | Yu et al. | |
| 2018/0347078 | A1 | 12/2018 | Goenka et al. | |
| 2018/0347080 | A1 | 12/2018 | Goenka et al. | |
| 2019/0106813 | A1 | 4/2019 | Koo | |
| 2020/0032424 | A1 | 1/2020 | Bainbridge et al. | |
| 2020/0058844 | A1 | 2/2020 | Tanimoto et al. | |
| 2020/0378039 | A1 | 12/2020 | Koo | |
| 2021/0108341 | A1 | 4/2021 | Huang et al. | |

FOREIGN PATENT DOCUMENTS

| | | | |
|---|---|---|---|
| JP | 2007056439 | A | 3/2007 |
| WO | 0212602 | A1 | 2/2002 |
| WO | 03012183 | A1 | 2/2003 |

OTHER PUBLICATIONS

C. Yu, Natural Textile Fibers: Vegetable Fibers, Textiles and Fashion, 2015, pp. 29-40, Elsevier Ltd.

* cited by examiner

HYGRO TEXTILE STRUCTURES AND RELATED PROCESSES

CROSS-REFERENCE TO RELATED APPLICATION

The present application claims priority to and the benefit of Indian Application No. 201721019835, filed Jun. 6, 2017, the entire contents of which are incorporated by reference herein.

TECHNICAL FIELD

The present disclosure relates to hygro textile structures and related processes for making hygro textile structures, and in particular to hygro yarn structures for use in home textile applications, such as bedding, bath, and/or kitchen applications.

BACKGROUND

Hygro materials can be used to describe materials, such as yarns and fabrics, which absorb water or moisture. Textile materials can absorb water through the fiber structure itself. For instance, cotton fibers are highly absorbent and textile materials that use cotton fibers can be absorbent materials. Textile materials can also be designed to absorb moisture through the specific yarn and woven fabric constructions. For example, lightly twisted yarn structure may absorb more moisture than highly twisted yarn structures. In another example, terry fabrics can typically absorb more moisture than flat fabrics due to the presence of piles and increased surface area available to absorb and transport moisture. It is challenging to balance the ability of a fabric structure to absorb moisture with the need to maintaining fabric durability and softness. This effort is further challenged by developing yarn structures that can readily withstand the rigors of weaving or other textile processes.

SUMMARY

A first embodiment of the present disclosure is a package dyed plied staple yarn that is elongated along a length. The package dyed plied staple yarn includes a first package dyed staple yarn having a first outer sheath of staple fibers twisted together and a first hollow core within the first outer sheath of the staple fibers. The first hollow core extends along the length of the plied staple yarn. The package dyed plied staple yarn also includes a second package dyed staple yarn having a second outer sheath of staple fibers twisted together and a second hollow core within the first outer sheath of the staple fibers. The second hollow core extends along the length of the plied staple yarn. The first packaged dyed staple yarn and the second package dyed staple yarn are twisted around each other and about a yarn central axis that is aligned with the length of the plied staple yarn. In one example of the first embodiment, each package dyed staple yarn includes color agents disposed in each of the staple fibers. In another example of the first embodiment, each package dyed staple yarn is a single end staple yarn. In another example of the first embodiment, the first and second hollow cores each include water soluble fibers. Another example of the first embodiment is a cross-wound package that includes the plied staple yarn of the first embodiment is wound onto a cross-wound package. The package dyed plied yarn of the first embodiment can formed into a bedding articles, a bath articles, and/or a kitchen articles, and the like.

A second embodiment of the present disclosure is a process for manufacturing a textile structure. The process of the second embodiment includes spinning a first staple yarn to include a first outer sheath of staple fibers twisted around a first inner core of water soluble fibers and spinning a second staple yarn to include a second outer sheath of staple fibers twisted around a second inner core of water soluble fibers. The process of the second embodiment includes plying the first staple yarn and the second staple into a plied staple yarn. The process further includes winding the plied staple yarn into a yarn package. With the plied staple yarn on the yarn package, the first and second inner core of the water soluble fibers are removed from each one of the first and second staple yarns in the plied staple yarn to form first and second hollow cores in the first and second staple yarns, respectively. The process thereby forms a plied packaged dyed staple yarn. In one example of the second embodiment, the removing step includes dyeing the plied staple yarns.

A third embodiment of the present disclosure is a spun staple yarn that include multi-core staple yarns includes an elongated assembly of staple fibers defining a length that extends along a yarn central axis. The staple fibers are twisted about the yarn central axis along an entirety of the length. The elongated assembly of staple fibers includes a first hollow core that extends along the length, and a second hollow core that extends along the length. The first hollow core and the second hollow core twist around the central yarn axis with respect to each other as each core extends along the length. In one example of the third embodiment, the first and second hollow cores each include water soluble fibers. Another example of the third embodiment includes a cross-wound package of the multi-core spun staple yarn. The spun staple yarn of the third embodiment can formed into a bedding articles, a bath articles, and/or a kitchen articles, and the like.

A fourth embodiment of the present disclosure is a process for manufacturing a multi-core staple yarn. The process includes spinning staple yarns to include an outer sheath of staple fibers twisted around a first core of water soluble fibers and a second core of water soluble fibers. The process includes removing the first and second cores of water soluble fibers from each one of the staple yarns to form a multi-core staple yarn. In one example of the fourth embodiment, the removing step includes dyeing the staple yarns.

BRIEF DESCRIPTION OF THE DRAWINGS

The foregoing summary, as well as the following detailed description of illustrative embodiments of the present application, will be better understood when read in conjunction with the appended drawings, which are described below. For the purposes of illustrating the present application, there is shown in the drawings illustrative embodiments of the disclosure. It should be understood, however, that the application is not limited to the precise arrangements and instrumentalities shown.

DETAILED DESCRIPTION OF ILLUSTRATIVE EMBODIMENTS

Embodiments of the present disclosure include unique "hygro" textile structures, such as yarns, fabrics, and related articles that are highly absorbent, hydrophilic, soft, and adapted for home textile applications. The hygro textile structures may be suitable for bedding articles, bath articles, kitchen articles, and the like. Also described herein are processes and devices used to manufacture hygro textile structures. The hygro textile structures as described herein are formed with yarn configurations that include an outer sheath of fibers that surround inner, multiple, hollow core(s). The multiple hollow cores are formed by the removal of soluble fibers, e.g. water soluble fibers, during the manufacturing process, as will be further explained below.

Figure 7A:
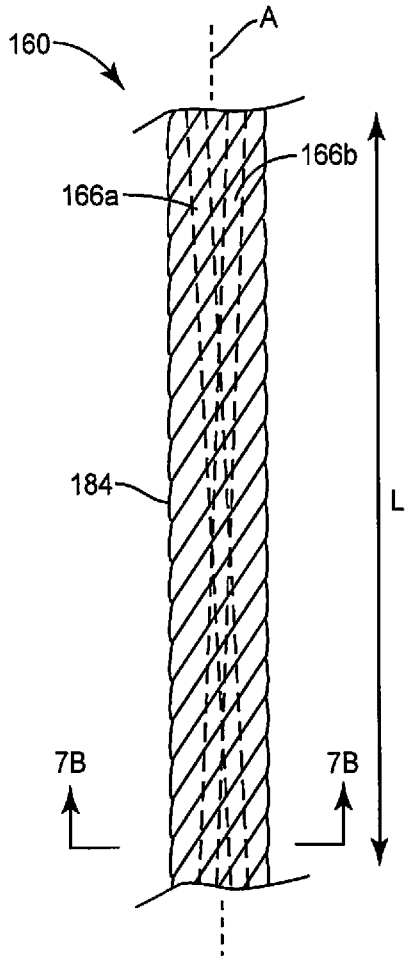
FIG. 7A is a schematic side view of the multi-core hygro yarn used in fabrics illustrated in FIGS. 1A-2.
Figure 8A:
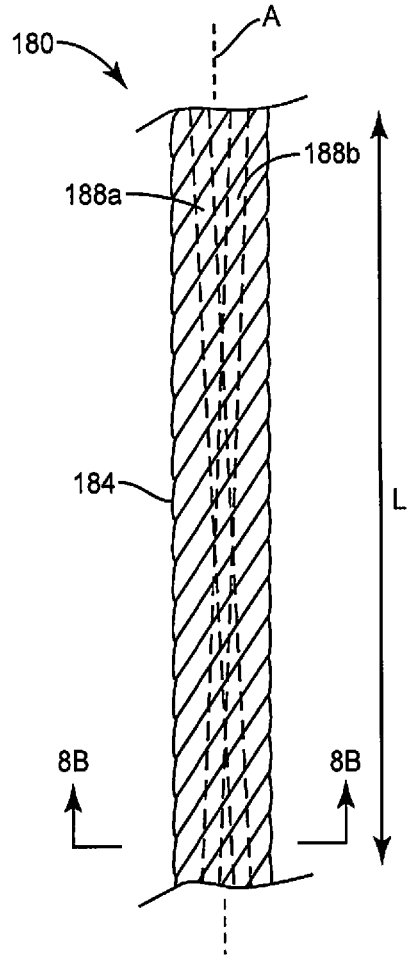
FIG. 8A is a schematic side view of the multi-core hygro yarn illustrated in FIG. 7A, after the first and water soluble fiber cores have been removed.
Figure 7B:
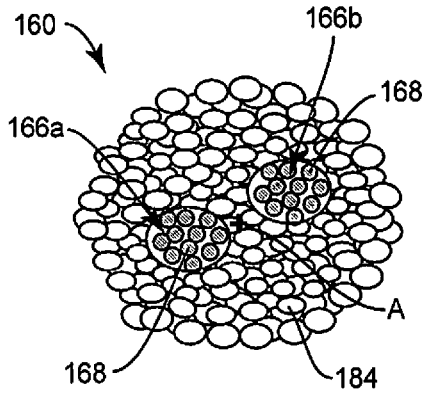
FIG. 7B is cross-sectional view of the multi-core yarn, taken along line 7-7 in FIG. 7A, and illustrating the first and second water soluble fiber core.
Figure 8B:
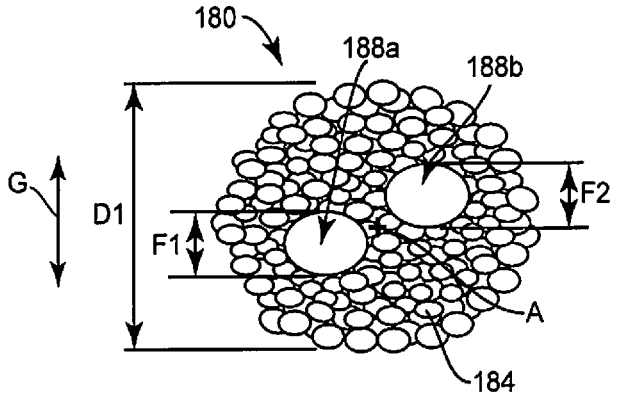
FIG. 8B is cross-sectional view of the multi-core yarn, taken along line 8-8 in FIG. 8A, and illustrating the first and second water soluble fiber core.

The yarn configurations described in the present disclosure can have one of several different structures. In one embodiment, the yarn configuration is a plied yarn formed from single end yarns that include a core of soluble fibers, as shown FIGS. 3A and 3B. After the soluble fibers are removed, the resulting structure is a plied hygro yarn 80 of multiple single end yarns, each of which have a hollow core, as shown FIGS. 4A and 4B. The process used to form the yarn structures illustrated in FIGS. 3A to 4B will be described in detail below. In another embodiment, the yarn configuration is a single end yarn formed to include multiple cores of soluble fibers, as shown FIGS. 7A and 7B. After the soluble fibers are removed, the resulting structure is a single end, multi-core yarn 180 that includes multiple hollow cores, as shown FIGS. 8A and 8B. The process used to form the yarn multi-core yarn 180 illustrated in FIGS. 7A-8B will also be described in further below. The yarn structures that include soluble fibers as illustrated in the FIGS. 3A and 3B and in FIGS. 7A and 7B are referred to in the present disclosure as "intermediate yarns." The yarn structures where the soluble fibers have been removed as illustrated in the FIGS. 4A and 4B and in FIGS. 8A and 8B are referred to in the present disclosure as "hygro yarns."

Figure 4A:
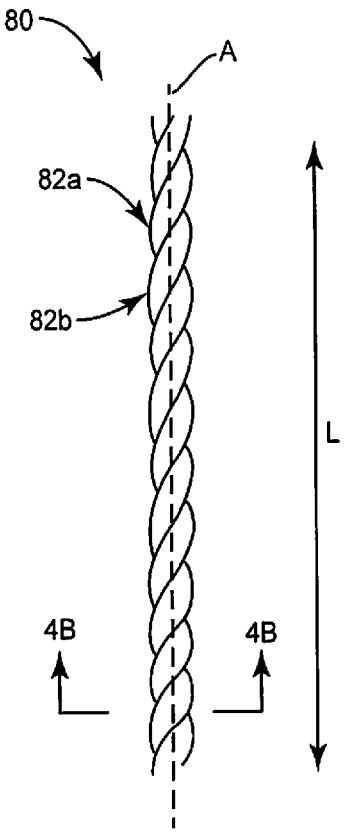
FIG. 4A is a schematic side view of the plied hygro yarn illustrated in FIGS. 3A, after the water soluble fiber core has been removed.
Figure 4B:
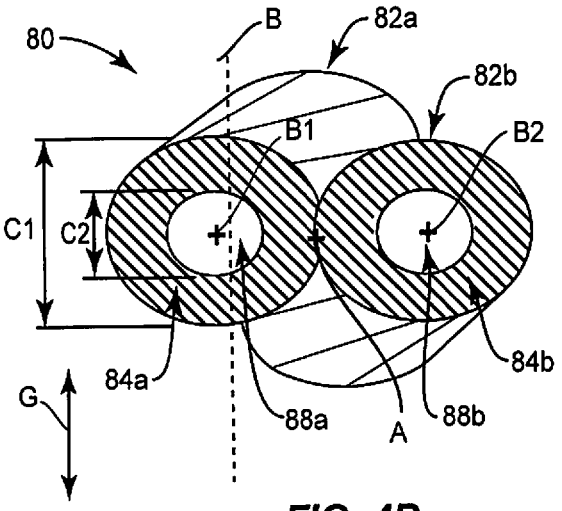
FIG. 4B is cross-sectional view of the plied hygro yarn, taken along line 4-4 in FIG. 4A, and illustrating the hollow core after the water soluble fiber core has been removed.

The resulting hygro yarn configurations as described herein in many circumstances boost manufacturing efficiency and improve end-product quality. For instance, the plied yarn yarns 80 as shown FIGS. 4A and 4B may result in fewer end breaks during weaving, increasing weaving efficiency. The plied yarns 80 shown in FIGS. 4A and 4B are also packaged dyed yarns, which can result in better color fastness in the finished product, among other benefits discussed below. For multi-core yarns 180 shown in FIGS. 8A and 8B, the process used to form the yarns 180 results in increased productivity, which in turn, increases overall efficiency along the yarn-to-textile article supply chain. Embodiments of the present disclosure thus improve upon existing technologies used to form hygro yarns that include an outer sheath of cotton fibers and a single hollow core, such as those described in U.S. Pat. No. 8,733,075, entitled, Hygro Materials For Use In Making Yarns And Fabrics," (the "075 patent"). The disclosure of the 075 patent which is not inconsistent with the present disclosure is herein incorporated by reference.

Figure 1A:
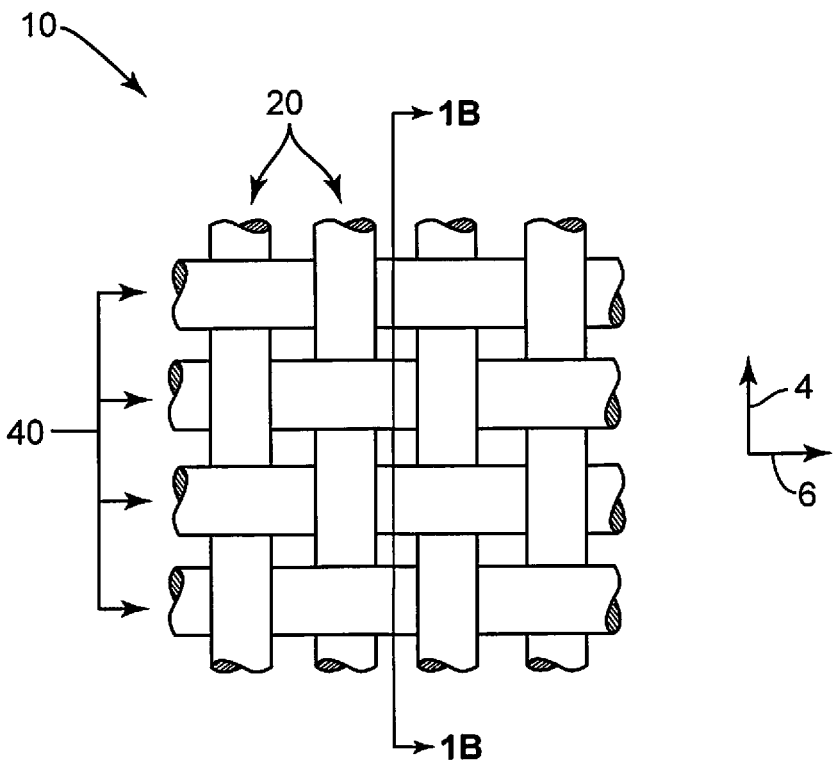
FIG. 1A is a schematic view of a woven fabric formed with hygro yarns according to an embodiment of the present disclosure.
Figure 1B:
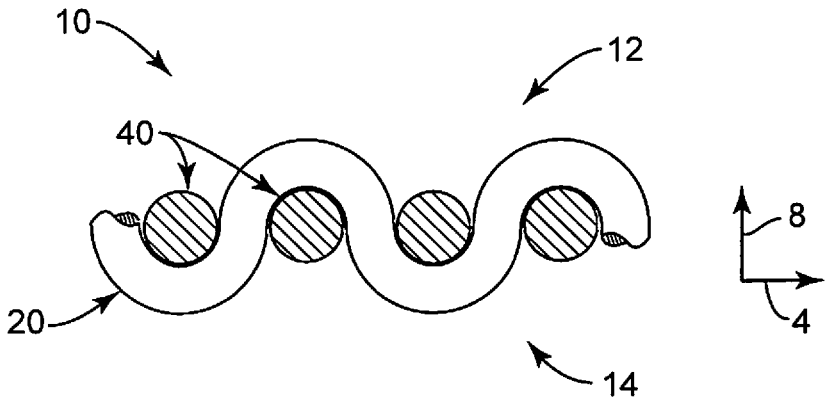
FIG. 1B is a cross-sectional view of the woven fabric taken along line 1-1 in FIG. 1A.
Figure 2:
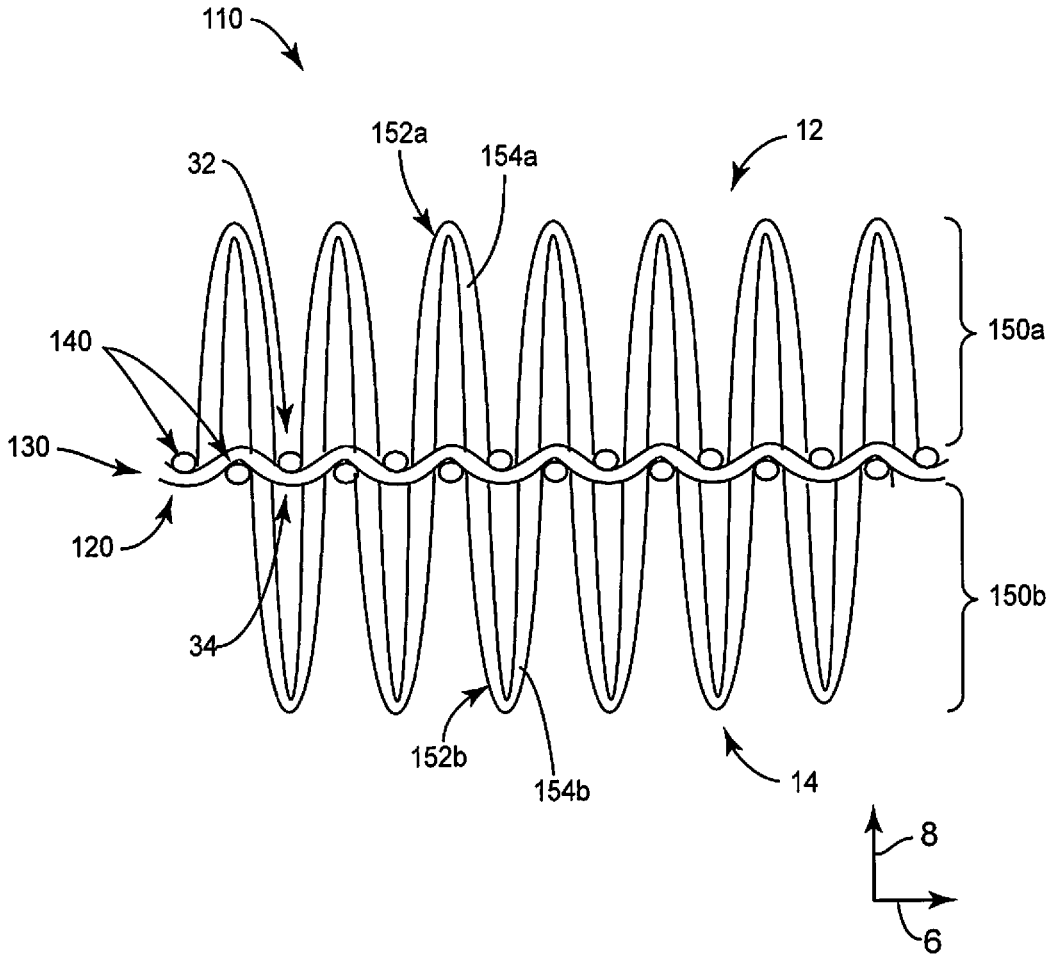
FIG. 2 is a sectional side view of a terry fabric woven including hygro yarns according to another embodiment of the present disclosure.

Embodiments of the present disclosure also include woven fabrics formed using the hygro yarns as described herein. The woven fabrics may include a flat woven fabric 10 as shown in FIGS. 1A and 1B, or a terry fabric 110 as shown in FIG. 2. It should be appreciated that the flat woven fabric 10 or terry fabric 110 may be formed using either the plied staple hygro yarns 80 (FIGS. 4A, 4B) and/or the multi-core staple hygro yarns 180 (FIGS. 8A, 8B). The flat woven fabric 10 and the terry fabric 110 are each described next.

Referring to FIGS. 1A and 1B, the flat woven fabric 10 includes a warp component having warp yarns 20, and a weft component including weft yarns 40 that are interwoven with the warp yarns 20 to define the woven fabric. The warp yarns 20 extends along a warp direction 4 and the weft yarns extend along a weft or fill direction 6 that is perpendicular to the warp direction 4. The woven fabric 10 includes a face 12, and back 14 opposite the face 12 along a thickness direction 8 that is perpendicular to the warp direction 4 and the weft direction 6. As illustrated, either or both of the warp component and the weft component may include the various hygro yarn configurations described herein. In one example, either or both of the warp component and the weft component the plied hygro yarn 80 as described herein. In another example, either or both of the warp component and the weft component may include the multi-core yarns 180 as describe herein. The flat woven fabrics 10 as described herein are suitable for bedding applications. Accordingly, the flat woven fabric 10 can be converted into a bedding article that may include, but is not limited to, a flat sheet, a fitted sheet, a comforter, a pillow case, and a pillow sham.

Turning to FIG. 2, a terry woven fabric 110 is illustrated that includes a ground component 130 that includes warp yarns 120 and weft yarns 140 interwoven with the warp yarns 120. The terry woven fabric 110 also includes one or more pile components 150*a*, 150*b*. The ground component 130 includes a first side 32 and a second side 34 opposite the first side. The pile component 150*a* and 150*b* extend away from opposite sides 32 and 34 of the ground component 130 along a thickness direction 8. The warp yarns 120 extend along a warp direction 4, which is perpendicular to the weft direction 6 and the thickness direction 8. The weft yarns 140 extend along a weft or fill direction 6 that is perpendicular to the warp direction 4. The woven fabric 110 includes a face 12, and back 14 opposite the face 12 along a thickness direction 8 that is perpendicular to the warp direction 4 and the weft direction 6. The terminal ends of the pile components 150*a* and 150*b* can define the face 12 and back 14 of the woven fabric 110. The piles have a pile height H that extends from the ground component to the terminal ends of the piles.

As illustrated in FIG. 2, the terry woven fabric 110 includes a first pile component 150*a* and a second pile component 150*b*. However, embodiments of the present disclosure include terry fabrics with the only one pile component. Each pile component 150*a*, 150*b* includes a plurality of piles 152*a*, 152*b* that project in a direction away from the ground component 130. The piles 152*a*, 152*b* are defined by pile yarns 154*a*, 154*b* interwoven with the ground component 130. The terry woven fabric 110 can be formed using any of the hygro yarn configurations described in the present disclosure. In one example, the pile yarns 154*a*, 154*b* may include the plied hygro yarns 80. Furthermore, one or both of the warp yarns 120 and the weft yarns 140 may include the plied hygro yarns 80. In another example, however, the pile yarns 154*a*, 154*b* may include the multi-core yarns 180. In such an example, one or both of the warp yarns 120 and the weft yarns 140 may include the multi-core yarns 180. The terry woven fabrics 110 may be converted bath and/or kitchen products, such as towel articles. Accordingly, the terry articles may include, but are limited to a towel, wash cloth, hand towel, rug, and a kitchen cloth.

Figure 3A:
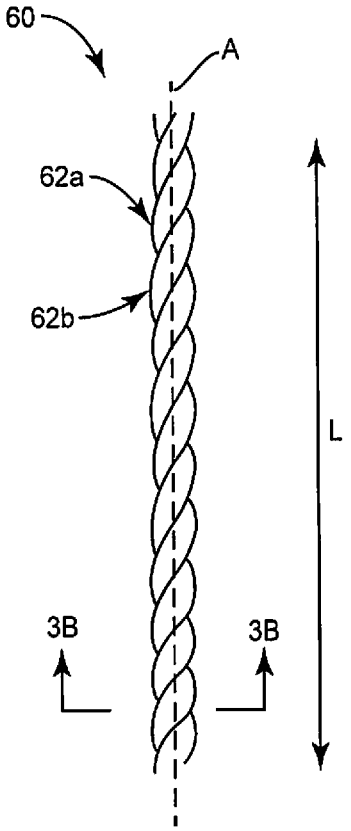
FIG. 3A is a schematic side view of a hygro yarn used in to form the fabrics illustrated in FIGS. 1A-2.

FIGS. 3A-6 illustrate the intermediate plied yarns 60, plied hygro yarns 80, and processes used form textile articles with the plied hygro yarns 80. Each of the yarns shown in FIGS. 3A-4B is a plied yarn structure made of a plurality of separate, packaged dyed yarns twisted together into a plied yarn configuration. Yarn structures before and after removal of the soluble fibers are illustrated in FIGS. 3A-3B and 4A-4B, respectively. FIGS. 3A and 3B illustrates a plied yarn 60 with two staple yarns 62*a* and 62*b*, each having an outer sheath 84*a*,84*b* of staple fibers and a core 66*a*, 66*b* of soluble fibers. A plied yarn with cores of soluble fibers may be referred to as an intermediate plied yarn 60. FIGS. 4A and 4B illustrate the plied yarn 80 after the soluble fibers have been removed, for instance via yarn or packaging dyeing. The plied yarn 80 has a plurality of separate packaged dyed staple yarns 82*a*, 82*b* twisted together into the plied yarn configuration. Each package dyed staple yarn has a hollow core 88*a*, 88*b* surrounded by the outer sheath 84*a*, 84*b* of staple fibers. As illustrated, the plied staple yarn 80 is a two-ply yarn that includes a first staple yarn 82*a* and a second staple yarn 82*b* twisted with the first staple yarn 82*a* to define the two-ply yarn 80. However, the plied staple yarn can have more than two separate yarns. A plied yarn with cores of soluble fibers removed is referred to as a plied hygro yarn 60 or plied yarn 60. Both the intermediate yarn 60 and the plied hygro yarn will be described in more detail next.

Referring to FIGS. 3A-4B, the intermediate yarn 60 includes an outer sheath of staple fibers and an inner core of soluble fibers. The outer sheath 84*a*, 84*b* of staple fibers may be cotton fibers. Alternatively, and merely for example, in place of cotton, the outer sheath may contain viscose fibers, modal fibers, silk fibers, modal fibers, acrylic fibers, polyethylene terephthalate (PET) fibers, polyamide fibers, are fibers blends. Fiber blends, for example, may include: blends of cotton and bamboo; blends of cotton and sea weed fibers; blends of cotton and silver fibers; blends of cotton and charcoal fibers; blends of PET fibers and cotton; blends of PET and viscose; blends of cotton and modal; blends of cotton; silk and modal; and any combinations thereof. The sheath may, for example, be 100% cotton or a combination of any of the foregoing blends.

The inner core of soluble fibers may be water soluble fibers. In one example, the water soluble fibers are polyvinyl alcohol (PVA) fibers. PVA fibers are synthetic fibers available in the form of filaments and cut staple fibers. PVA fibers are preferably easily dissolved in warm or hot water at about 50 degrees Celsius to about 110 degree Celsius without the aid of any chemical agents. However, it should be appreciated that other fibers that can be removed and/or dissolved with water or other specific agents that can leave an outer sheath of fibers intact may be used. The description here refers to use of PVA fibers and water soluble fibers interchangeably for ease of illustrating embodiments of the present disclosure. The present disclosure is not limited to PVA fibers unless the claims recite PVA fibers. The amount of soluble fibers dissolved depends, in part, on the count of the yarn or yarns used. The amount of soluble fibers present can vary from about 5% to about 40% of the weight of the yarn. The balance of the weight is comprised of the outer sheath of staple fibers. In one example, the soluble fibers may vary from about 10% to about 30% of the weight of the yarn. In one example, the soluble fibers may vary from about 15% to about 25% of the weight of the yarn. In one example, the soluble fibers may vary from about 17% to about 23% of the weight of the yarn. In one example, the soluble fibers may be about 20% of the weight of the yarn. However, it should be appreciated that the amount of soluble fibers can be any specific amount between 5% to about 40%. Each intermediate yarns 62*a*, 62*b* may include similar soluble fiber content. In other embodiments, however, the weight content of the water soluble fibers between the first intermediate yarn 62*a* and the second intermediate yarn 62*b* can vary with respect to each other.

In accordance with illustrated embodiment, the intermediate plied yarns 60 (or separate intermediate yarns 62*a*, 62*b*) are dyed prior to fabric formation to remove the core 66*a*, 66*b* of soluble fibers and apply color to the staple fibers in the outer sheath 84*a*, 84*b*. Following removal of the core 66*a*, 66*b* of soluble fibers, each yarn has an outer sheath 84*a*, 84*b* of staple fibers twisted around a hollow core to define the plied yarn 80 as illustrated in FIGS. 4A and 4B. By dissolving the soluble fibers, e.g. PVA fibers, hollow air spaces are formed throughout the yarns, corresponding to an increase in the air space in the yarn. By increasing the air space in the yarn, the textile articles formed therefrom are softer and bulkier than textile articles made without the hygro yarns as described herein.

Turning to FIGS. 4A and 4B, removal of the soluble fibers from the intermediate yarn 60 results in a plied staple yarn 80 having a plurality of separate, package dyed staple yarns 82*a*, 82*b* that each include a hollow core. As illustrated in FIGS. 4A and 4B, the plied staple yarn 80 includes a first package dyed staple yarn 82*a* and a second package dyed staple yarn 82*b* twisted with the first staple yarn 82*a* to define a two-ply yarn. Each separate dyed staple yarn 82*a*, 82*b* includes an outer sheath 84*a*, 84*b* of staple fibers (which were previously dyed) twisted together around a hollow core 88*a*, 88*b*. The plied yarn 80 extends along a length L that is aligned with a plied yarn central axis A. Accordingly, it can be said that the first and second staple yarns 82*a*, 82*b* extend along the length L of the plied yarn 80. However, as can be seen in the figures, the first dyed staple yarn 82*a* and the second dyed staple yarn 82*b* are twisted with respect to each other and about the central axis A. As can be seen in FIGS. 4A and 4B, the first staple yarn 82*a* has a first central axis B1. The outer sheath 84*a* of fibers in the first dyed staple yarn 82*a* is twisted about the first central axis B1 such that the hollow core 88*a* extends along the first central axis B1. Likewise, the second dyed staple yarn 82*b* has a second central axis B2. The outer sheath 84*b* of fibers in the second dyed staple yarn 82*a* are twisted about the second central axis B2 such that the hollow core 88*b* extends along the second central axis B2. The plied yarn 80 defines a helical type structure whereby the first and second central axes B1 and B2 twist around the plied yarn central axis A and with respect to each other.

The hollow cores 88*a*, 88*b* comprise a predefined portion of separate, dyed staple yarns 82*a* and 82*b*. The predefined portion may be described in terms of a percentage of yarn cross-sectional dimension (e.g. distance) and/or volume of the dyed staple yarn 82*a*, 82*b* or plied yarn 80. For instance, each dyed staple yarn 82*a*, 82*b* defines a yarn cross-sectional dimension C1 that is perpendicular to the yarn central axis A and the respective yarn central axis B1, B2 (FIG. 4B). The hollow core 88*a*, 88*b* defines a cross-sectional dimension C2 that is perpendicular to the respective yarn central axis B1, B2 (FIG. 4B). In this instance, the cross-sectional dimension C2 of the hollow core is aligned with the yarn cross-sectional dimension C1 of separate staple yarn 82*a*, 82*b* along a direction G. In other words, the cross-sectional dimensions C1 and C2 are defined along a similar direction G. The phrase "cross-sectional dimension" is the longest distance across a point of reference in the yarn structure. For instance, an idealized yarn structure has a circular cross section. In that case the cross-sectional dimension would be referred to as the diameter of the yarn. However, a yarn structure may not have a perfectly circular cross-section. Furthermore, in practice, it is believed the collapse of the yarn structure, fiber migration, and twist variances along the length could distort the cross-sectional shape of the hollow core. The cross-sectional dimension may be measured using image analysis techniques to obtain relative measurements of the yarn dimensions. In accordance with the illustrated embodiment, the hollow core 88*a*, 88*b* defines between about 8% to about 40% of the cross-sectional dimension C1 of the dyed staple yarn 82*a*, 82*b*. In other words, the hollow core has a cross-sectional dimension C2 that is between about 8% to about 40% of the cross-sectional dimension C1 of the staple yarn 82*a*, 82*b*. This percentage corresponds to the approximate weight percentage of water soluble fibers in the intermediate staple yarns 62*a*, 62*b* before remove of the water soluble fibers. In one example, the hollow core defines between about 10% to about 30% of the cross-sectional dimension C1. In another example, the hollow core defines between about 15% to about 25% of the cross-sectional dimension C1.

Similarly, the hollow core 88*a*, 88*b* comprises a defined volume percentage of the dyed staple yarns. Volume percentage is determined assuming that the dyed staple yarns 82*a*, 82*b* are cylindrical. A person of skill would appreciate the use of volume percentage based on this assumption. The yarn volume V1 is equal to $\pi(C1/2)^2*h$, where C1 is the cross-sectional dimension C1 defined above and h is a given length L of the yarn 82*a*, 82*b*. The hollow core volume V2 is equal to $\pi(C2/2)*h$, where C2 is the cross-sectional dimension C2 of the hollow care defined above and h is a given length L of the yarn 82*a*, 82*b*. The volume percentage of the hollow core is equal to (V2/V1)*100. In accordance with the illustrated embodiment, the hollow core 88*a*, 88*b* comprises between about 8% to about 40% of the volume of the dyed staple yarn 82*a*, 82*b*. In one example, the hollow core 88*a*, 88*b* defines between about 10% to about 30% of the volume of the dyed staple yarn 82*a*, 82*b*. In another example, the hollow core 88*a*, 88*b* defines between about 15% to about 25% of the volume of the dyed staple yarn. The volume percentage of the hollow core 88*a*, 88*b* also corresponds to the approximate weight percentage of water soluble fibers in the intermediate staple yarns 62*a*, 62*b* before remove of the water soluble fibers.

The plied yarn 80 can be twisted to have ether a z-twist or a s-twist. Each yarn in the plied yarn can have a twist direction that is opposite to the twist direction of the plied yarn. For instance, if the plied yarn has a Z-twist, each yarn end will have an s-twist and vice versa. Furthermore, while a two-ply yarn is illustrated in the figures, the plied yarn 80 as described herein is not limited to two-plies. The plied yarns can be 3-ply or 4 ply yarns. In one example, the plied yarn is a three-ply yarn that includes a first package dyed staple yarn, a second package dyed staple yarn, and a third package dyed staple yarn twisted into a plied structure.

The plied yarns 80 are formed to have strength sufficient for formation into the woven fabrics 10 and 110. In conventional hygro yarns, such as those disclosed in the 075 patent, the water soluble fibers are removed after fabric formation. Hence, during manufacturing, the hygro yarns have a weight and strength that is suitable to withstand the rigors of the weaving process. In present disclosure, however, the water soluble fibers are removed before weaving, as will be further explained below. This results in a generally lower mass of yarn, if for example, single end yarns are used during weaving. The loss of mass in the yarn due to the removal of water soluble fibers decreases yarn strength. The present embodiment balances this decrease in strength by plying the singled end yarns together prior to removal of the water soluble fibers. Accordingly, each package dyed staple yarn 82*a*, 82*b* has a strength that is less than the tensile strength of the plied yarns 80. In certain exemplary cases, each package dyed staple yarn 82*a*, 82*b* may not be well suited to withstand the rigors of the weaving cycle, whether used as warp or weft yarns, due to the hollow core. Plied yarns 80, however, can be woven into fabrics 10 and 110 due to the increased strength and are suitable for withstanding the weaving motions and forces applied the yarn structures during weaving.

Figure 5:
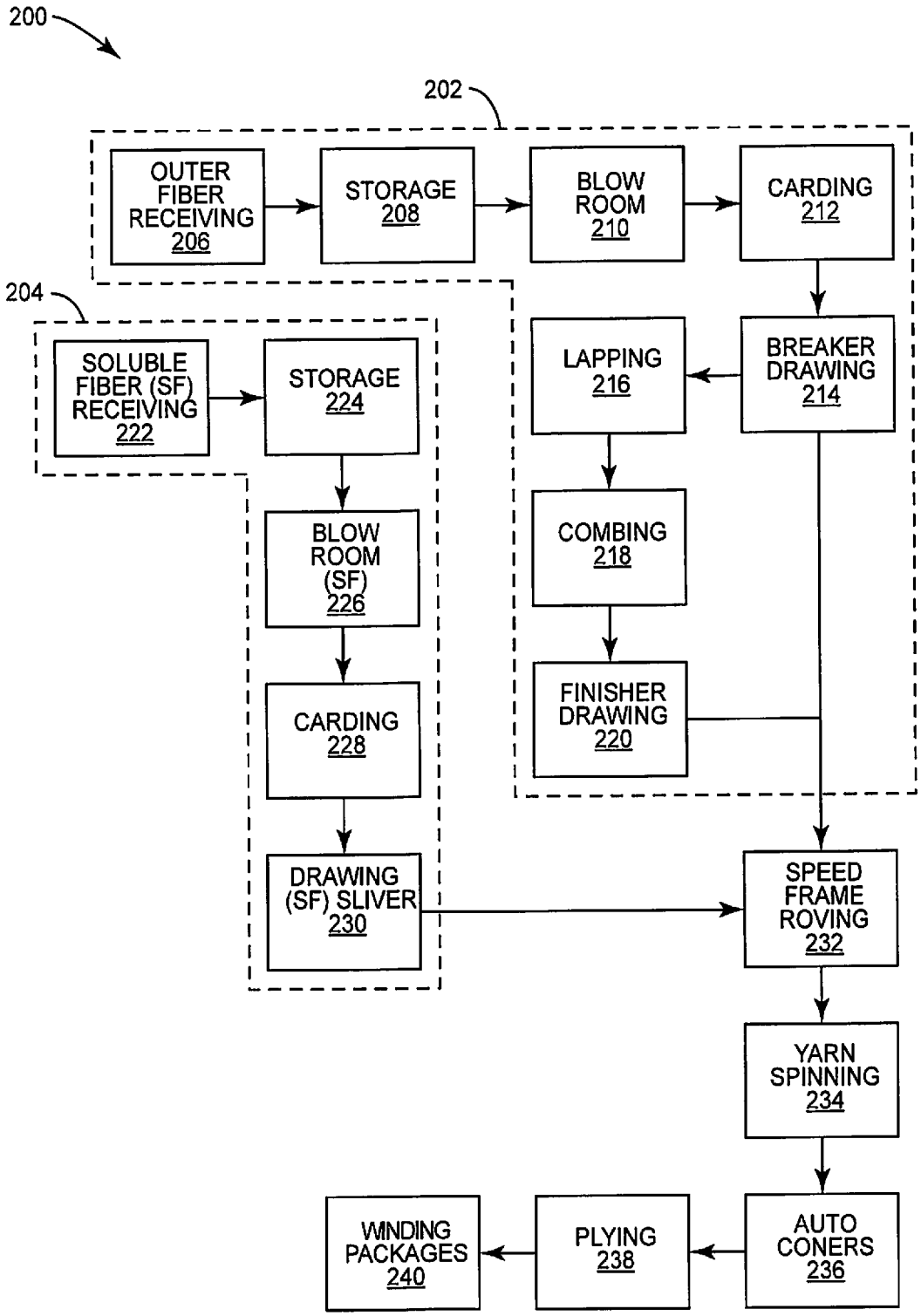
FIG. 5 a process flow diagram for manufacturing the plied hygro yarn, according to an embodiment of the present disclosure.
Figure 6:
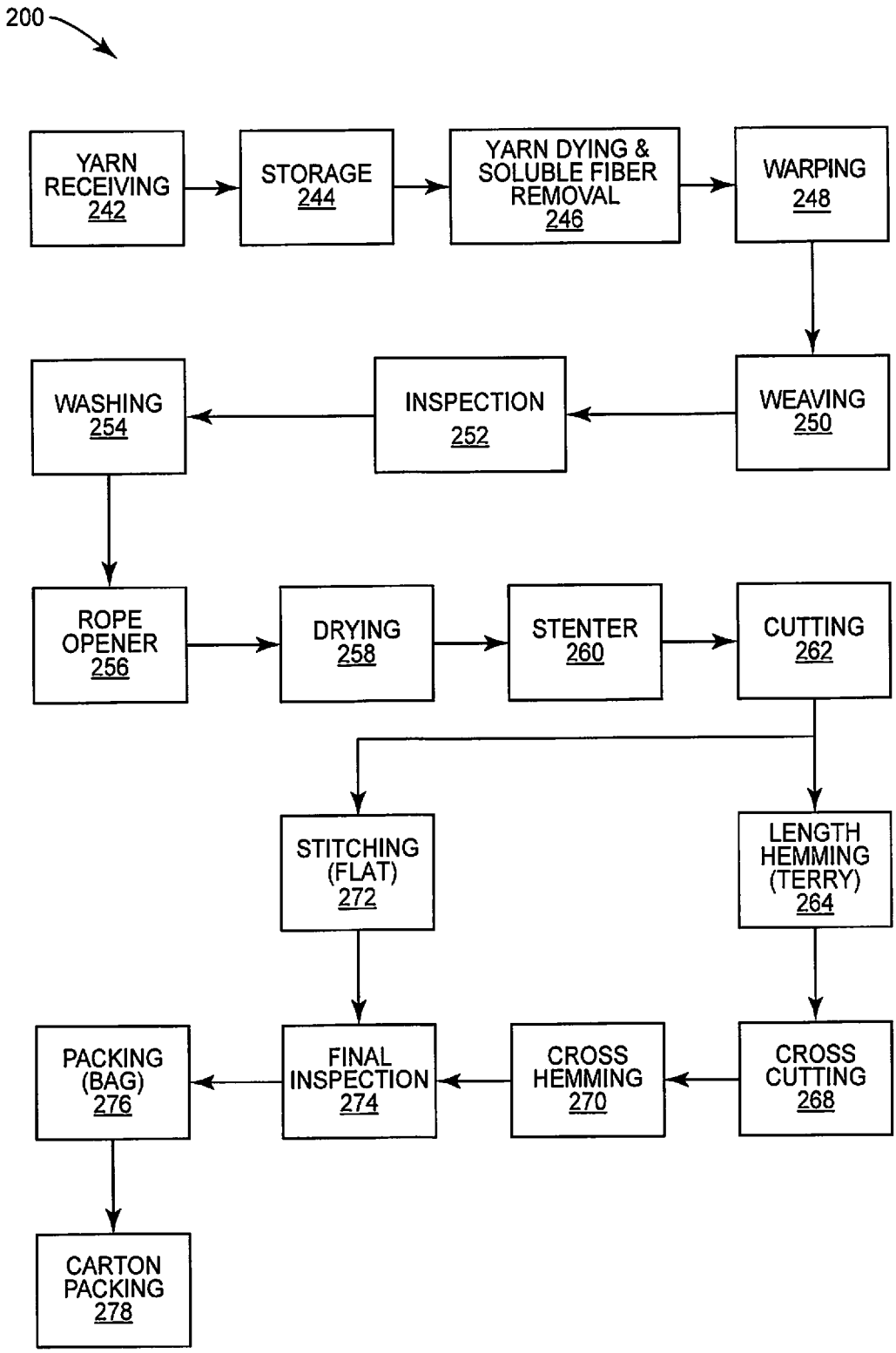
FIG. 6 a process flow diagram for manufacturing textile articles with the plied hygro yarns, according to an embodiment of the present disclosure.

Forming the plied yarn 80 illustrated in FIGS. 4A-4B into textile articles will be described next. FIGS. 5 and 6 illustrate a method 200 for manufacturing hygro textile articles with the plied yarns 80 according to an embodiment of the present disclosure. The method 200 described below refers to use of cotton fiber in the outer sheath and of PVA fibers used to form the inner core. However, it should be appreciated that other fibers can be used in the outer sheath and an inner core, as described above.

The method 200 illustrated includes two preliminary phases: outer sheath sliver formation 202 and soluble fiber sliver formation 204. Outer sheath sliver formation 202 creates slivers used to form the outer sheath 84*as*, 84*b*, of fibers in the intermediate yarns 62*a*, 62*b* while soluble fiber sliver formation 204 creates slivers used to form the inner core of soluble fibers 66*a*,66*b* in the intermediate yarns 62*a*, 62*b*.

Outer sheath fiber formation phase 202 forms slivers of staple fibers for roving. Outer fiber sliver formation initiates with fiber receiving 206 and storage 208. In one example, the outer fibers are cotton fibers. The outer cover sliver (or outer sheath) may be made from, for example, cotton fibers or blends of cotton fiber or other fibers blends as described above. Described below is an exemplary process of forming a cotton slivers. The 075 patent includes properties of exemplary cotton fibers suitable for processing as described herein. For clarity of description the outer sheath sliver formation phase 202 will be referred to as outer fiber sliver formation.

Next, the outer sheath fibers (or cotton fibers) are subject to an opening step 210 in a blow room. In the blow room, the cotton fibers are processed with a bale plucker, opener, multi-mixer, beater and a dustex machine. After opening 201, the fibers are carded 212 on card machines to deliver card slivers. The sliver from carding 212 is then processed through a breaker drawing step 214 to draw out the slivers. In one example of the breaker drawing step 214, the number of doublings at the feed end can be 6 and the hank delivered is maintained at about 0.12. In case of blended slivers, each component is separately processed through carding and the individual carded slivers are subsequently blended together on draw frames. From breaker drawing 214, the slivers can follow one of two processing step: a lapping step 216 or fed directly roving step 232.

In instances where combing is needed, processing proceeds from the breaker drawing 214 to the lapping step 216. As should be appreciated, combing is used to remove short fibers during cotton processing. In the lapping step 216, a unilap machine converts doublings into a lap of fibers. The lap is processed in a combing step 218 using a comber. The combed cotton sliver is then passed through another finisher drawing step 220 using a finisher draw frame. In one example, the finisher draw frame has a feed hank of 0.12 and a delivery hank of 0.75 and at speeds up to about 400 meters per minute. The sliver hank exiting the drawing step 220 is kept relatively coarse (e.g. at 0.075) in order enable covering of the soluble fiber sliver during roving step.

Referring back to step 214, in certain instances, the slivers produced at breaker drawing step 214 are fed directly to the roving step 232, further explained below.

The formation of the soluble slivers is described next. Soluble fiber sliver formation initiates with fiber receiving 222 and storage 224. The description below refers to PVA fibers. But it should be understood that the description below is not limiting and other soluble fibers could be used in place of or in addition to PVA fibers. In one example, the denier of the PVA fibers may be range from about 0.9 denier to about 2.2 denier. The soluble fibers have a cut length that is equal to or more than 32 mm and equal to or shorter than 51 mm. However, other cut lengths can be used with modifications in the machine parameters during spinning. In an exemplary embodiment, the PVA fiber is 38 mm staple length and 1.4 denier. The 075 patent includes properties of exemplary PVA fibers suitable for processing as described herein.

Next, the soluble fibers are subject to an opening step 226 in a blow room in a "cotton" type spinning system. Here, the PVA fibers are first passed through a blow room having a feeder and a mono cylinder beater only. Because PVA fibers are synthetic, the PVA fibers are clean and have minimal impurities. Thus, less aggressive cleaning steps are needed during soluble sliver formation phase 204 compared to similar phases of processing cotton.

After opening 226, the PVA fibers are conveyed from the blow room to carding 228 to form card slivers, which are coiled into sliver cans. In one example, the carding machines are run between 100 and 120 meters per minute delivery speed and to yield a hank that can range between 0.05 to 0.40. The carded slivers are then further drawn via drawing step 230 to yield the PVA sliver. During the drawing step 230, the carded slivers are passed through one or more draw frames to further orient the fibers along the length of the sliver, i.e. to impart more parallelization, of the fibers. For instance, during drawing 230, the PVA slivers are initially processed with a breaker draw frame. A second pass of drawing in a finisher draw frame is used to further arrange the PVA fibers in parallel form with respect to each other. The delivery hank from the finisher draw frame is kept fine (e.g. at about 0.3 although it could be higher than 0.3) to enable the PVA sliver to be inserted into a central or middle portion on the cotton fiber sliver upon entry into the speed frame. An exemplary delivery speed at the finishing frame can be between 250 to 300 meters per minute. The output of the drawing step 220 are cans of PVA slivers.

After outer fiber sliver formation 202 and soluble fiber sliver formation 204, the cotton and PVA slivers are combined during roving 232. During roving 232, the PVA sliver is inserted into a middle or central portion of the cotton sliver at a speed frame. Specifically, the sliver cans of both cotton slivers and PVA slivers are positioned at a feed end of the speed frame. Suitable arrangements, such as guide pulleys on a roving machine creel, are made for guiding the PVA sliver and the cotton sliver from the sliver cans at the creel side of the speed frame.

The speed frame as described herein includes an inlet condenser, a middle condenser, a main feed condenser, multiple sets of drafting rollers, and a flyer. Typically, slivers are processed through an inlet zone, back drafting zone, middle drafting zone, and a forward drafting zone. The condensers are disposed along these different zones at or near their respective drafting rollers. The cotton sliver follows a normal path from the back to the front of the speed frame through at least the main feed condenser. The inlet and middle condensers are incorporated for feeding PVA slivers at the inlet, the back and middle drafting zones on the speed frame, to ensure that the PVA sliver stays in the middle of the cotton sliver. The PVA sliver, however, passes through the inlet condenser before occupying the middle portion on the cotton sliver in the main feed condenser. The middle condenser is incorporated in the back zone of the drafting system to retain the PVA sliver in the middle of the cotton sliver, as mentioned above. As the cotton and PVA slivers emerge out of the drafting zone on the speed frame, the twist flowing from the flyer to the nip of the front rollers of the speed frame causes the cotton fibers to wrap around the inner PVA sliver, thus forcing the PVA sliver into the core. The twisting and winding on to the bobbin on the speed frame is typical as with any other cotton roving system. For example, clock-wise rotation of the flyer can give "Z" twist. Alternatively, the roving can have an "S" twist, by reversing the direction of the rotation of the flyer to a counter-clockwise direction. The roving hank ranges from about 0.5 to about 5.0 hanks. In one example, the hank of roving can be about 0.58.

The roving step 232 described above feeds the PVA fiber roving into the path of the cotton roving in the drafting zone of a speed frame. However, placing PVA fibers in a core of staple fibers can be accomplished in a variety of ways. In one embodiment, the PVA fibers can be added via core-spinning machine. In another variation, the PVA roving is introduced in the path of cotton roving on the roving machine. Alternatively, the PVA can be added to the middle of the cotton roving by reversing the rotation of flyer in the counter-clockwise direction, which is opposite the direction of the normal flyer rotation. In both situations, the PVA fibers are placed in the middle of the cotton sliver during the roving process to yield a roving with a core of PVA fibers.

Figure 3B:
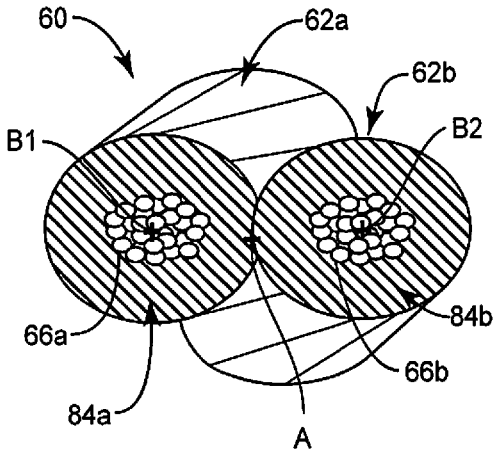
FIG. 3B is cross-sectional view of the hygro yarn taken along line 3-3 in FIG. 3A, and illustrating the water soluble fiber core.

After the roving step 232, a yarn spinning step 234 converts the rovings into single end intermediate yarns 62*a*, 62*b*. In accordance with illustrated embodiment, yarn spinning 234 is accomplished on a ring spinning frame using typical settings for forming ring spun yarns. The spinning parameters on the ring frame are set based on the type of fibers in the outer sheath and type and content of the PVA fibers in the inner core. The result of yarn spinning 234 is a single intermediate staple yarn 62*a* as illustrated in FIGS. 3A and 3B. The ring spinning frame can produce single end yarns with a count that ranges from about 8 Ne to about 100 Ne. Yarns used for flat woven fabric 10 (FIGS. 1A & 1B) may have a count that ranges from 10 Ne to about 100 Ne. Yarns used for terry fabrics 110 (FIG. 2) may have a count that ranges from about 8 Ne to about 50 Ne. After yarn spinning 234, the intermediate plied yarns 62*a*, 62*b* are further packaged 236 into suitable yarn packages using auto-coners. Those packages are then used in a plying step 238.

In plying step 238, the yarns plied into intermediate plied yarn 60 as shown in FIGS. 3A and 3B. In accordance with the illustrated embodiment, the plying step 238 uses two-for-one twisters to twist two single end yarns into a two-ply yarn. Accordingly, as shown, the intermediate plied staple yarn 60 is a two-ply yarn that includes a first intermediate staple yarn 62*a* and a second intermediate staple yarn 62*b* twisted with the first intermediate staple yarn 62*a* to define the intermediate plied yarn 60. The intermediate plied yarn 60 can have an overall twist per inch (TPI) from about 6.5 to about 14.5 TPI in an "S" direction. The twist direction can, however, be in a "Z" direction. Furthermore, the twist configuration can be either Z over S or Z over Z. The resultant yarn counts would be about 2/8s to about 2/50s for terry fabrics. Similarly the doubled yarns for flat fabrics may be from about 2/10s to about 2/100s. In alternative embodiments, the intermediate plied yarn 60 can be 3-ply yarn. Such a 3-ply intermediate yarn includes a first intermediate staple yarn, a second intermediate staple yarn, and a third intermediate staple yarn twisted into a plied structure. More plies than 3 can be used as needed. After yarn plying 238, the intermediate plied yarns 60 are wound 240 onto suitable yarn packages for further processing. For example, the plied yarn 60 can be cross-wound onto a yarn package. The yarn package may include a core and the plied yarn 60 wound onto the core. The core may be perforated to aid in dyeing the cross-wound package.

Turning to FIG. 6, the next phase in the production of hygro textile articles is soluble fiber removal, yarn dyeing, followed by fabric formation and article formation. As illustrated, the plied yarn packages formed during the packaging step 240 are received 242 and stored 244 for later processing in the fiber removal and coloration step 246. In step 246, the soluble fibers are removed from the inner core and color is applied to the fibers in the outer sheaths 84*a*, 84*b* with the plied yarns 80 wound onto the yarn packages. The process step 246 may occur in two phases where the soluble fibers are removed first followed by application of coloring agents. Alternatively, soluble fiber removal and color application can overlap. In accordance with the illustrated embodiment, the yarn packages are placed within a package dyeing machine and exposed to elevated water temperatures under pressure for a predetermined period of time, as will be understood by persons familiar with convention package dyeing machines and processes. In one example, the water temperatures range from at least about 95 degrees Celsius to about 120 degrees Celsius. In one preferred example, the temperature of water in the package dyeing machine during PVA removal is about 120 degrees Celsius, which can ensure that all the PVA dissolves leaving the hollow inner cores in each yarn of the plied yarn structure. The result of process step 240 is the plied yarn 80 with two yarns, each having an outer sheath of fibers and a hollow core, as illustrated in FIGS. 4A and 4B.

After process step 246, the plied yarns 80 proceed to a warping step 248. The warping step 248 includes typical warping operations for flat woven fabrics 10 and/or typical warping operations for terry fabrics 110. For instance, for terry fabrics 110, warping includes both ground yarn warping and pile yarn warping.

A weaving step 250 follows warping 248. The weaving step converts the yarns into woven fabrics. One or more looms, e.g. air-jet or rapier looms, can be use during the weaving step. Each loom may utilize typical shedding mechanism, such as a dobby or jacquard type shedding mechanism. During the weaving step for the woven fabric 10 (FIG. 1A, 1B), the warp and weft yarns can be arranged into a number of different weaving constructions and designs as is known by persons of skill in the art. Furthermore, for woven fabrics 10, the weft yarns, warp yarns, or both the warp and weft yarns can include the plied hygro yarns 80.

Furthermore, during the weaving step for terry fabrics 110, the ground, weft, and pile yarns are woven together using a loom configured for terry production. The terry fabric 110 can be 3-pick, 4-pick, 5-pick, 6-pick, or 7-pick terry. In the one example, the terry fabric 110 is a 3-pick terry. The pile component 150*a*, 150*b* can define a pile height H that extends from the ground component 130 to a top of a pile 154, 154*b* along the thickness direction 8. The pile height can range from about 2.0 to 10 mm. The weaving step 250, for both flat woven fabrics 10 and terry fabrics 110, results in "greige fabrics" that are further processed into textile articles.

After the weaving step 250, the griege fabrics are inspected 252 and washed 254 in a washing vessel. After unloading the woven fabrics from the washing vessel, the water is extracted in an extractor in the typical manner to reduce the moisture content. Next, an opening step 256 untwists the fabric using a rope opener, similar to the rope opener as described in the 075 patent. A drying step 258 may use a hot air dryer to further dry the fabrics and expose the fabrics to the desired temperature, as is typical in the art. The dried fabric is expanded to full width and then passed through a stentering step 260. The stentering step 260 can help straighten the fabric.

In certain alternative embodiments for processing terry fabrics, a shearing step is used, whereby both sides of the terry fabric are passed through a shearing machine. The shearing machine has cutting devices, such as blades and/or a laser, which are set such that only protruding fibers are cut and the piles are not cut. The shearing step reduced linting during subsequent washing in use by the consumer.

After the stentering 260 (or optional shearing step), a cutting step 262 cuts the woven fabrics to the desired length and width depending on the particular end use. The next phase of processing can be based on particular end-used and fabric type. Process steps 272, 274 and 276 may be used to form articles based on a flat woven fabric 10. For flat woven fabrics 10, after cutting 262, the cut woven fabric is stitched 272, inspected 274, and a packaged 276. Packaging 276 may include folding the formed articles and packing them into packages or containers for shipment. Alternatively, after the cutting 262, processing steps 266, 268, 276 and 278 are used to form textile articles based on terry fabrics 110. For terry fabrics 110, after cutting 262, the cut terry fabrics are hemmed 266, cross-cut 268, cross-hemmed 278, inspected 276, and packaged 278. A carton package step 278 follows to prepare the packages for transport to customers.

The process 200 described above utilizes a plied yarn 80 that has been package dyed prior to fabric formation. Next will be described an alternative process used to manufacture the multi-core hygro yarn 180 and various textile structures that include the multi-core hygro yarn 180.

FIGS. 7A-11 illustrate an intermediate multi-core yarn 160, multi-core hygro yarn 180, a processes 300 used form textile articles with the hygro yarns 180, and an apparatus 400 used during process 300 to form the hygro yarn 180. The yarn structures during and after removal of the water soluble fibers according to process 300 are illustrated in FIGS. 7A-8B. FIGS. 7A and 7B illustrates an intermediate yarn 160 with two yarns with pair of water soluble fiber cores 166*aa* and 166*b*. FIGS. 8A and 8B illustrates the resulting the hygro yarn 180 after the water soluble fibers have been removed resulting in a pair of hollow cores 188*a*, 188*b* surround by the outer sheath 184 of staple fibers. As illustrated, the hygro yarn 180 is a single ply yarn that includes a first hollow core 188*a* and a second hollow core 188*b* twisted with the first hollow core 188*a* about a yarn central axis A to define a multi-core hygro yarn 180.

As can be seen in FIGS. 7A-8B, the intermediate yarn 160 is formed to include an outer sheath of fibers 184 and an inner core 166*a*, 166*b* of water soluble fibers 168. The outer sheath 184 of fibers may be cotton fibers, similar to the embodiment described above and illustrated In FIGS. 3A-3B. Accordingly, the outer sheath of fibers 180 may include, in place of cotton, viscose fibers, modal fibers, silk fibers, modal fibers, acrylic fibers, polyethylene terephthalate (PET) fibers, polyamide fibers, or fibers blends. Fiber blends may, for example, include: blends of cotton and bamboo; blends of cotton and sea weed fibers; blends of cotton and silver fibers; blends of cotton and charcoal fibers; blends of PET fibers and cotton; blends of PET and viscose; blends of cotton and modal; blends of cotton; silk and modal; and any combinations thereof. The sheath may be 100% cotton or a combination of any of the foregoing blends.

The soluble fibers may be water soluble fibers as described above in the yarns 60 and 80 illustrated in FIGS. 3A-4B. In one example, the soluble fibers are polyvinyl alcohol (PVA) fibers. The present embodiment, however, is not limited to PVA fibers unless the claims recite PVA fibers. The amount of soluble fibers present in the intermediate yarn 160 can vary from about 5% to about 40% of the weight of the yarn 160. The balance of the weight is comprised of the outer sheath of staple fibers. In one example, the soluble fibers may vary from about 10% to about 30% of the weight of the yarn. In one example, the soluble fibers may vary from about 15% to about 25% of the weight of the yarn. In one example, the soluble fibers may vary from about 17% to about 23% of the weight of the yarn. In one example, the soluble fibers may be about 20% of the weight of the yarn. However, it should be appreciated that the amount of soluble fibers can be any specific amount between 5% to about 40%.

The intermediate yarns 160 are processed to remove the water soluble fibers after fabric formation, which is similar to the process as described in the 075 patent. In alternative embodiments, however, the intermediate yarns 160 can be dyed prior to fabric formation to remove the water soluble fiber core 166*a*, 66*b* of water soluble fibers and apply color to the fibers in the outer sheath 184. After removal of the first and second water soluble fiber cores 166*a* and 166*b*, each yarn has an outer sheath 184 of staple fibers twisted around a first and second hollow core 188*a* and 188*b* to define the multi-core yarn 180 as illustrated in FIGS. 8A and 8B. As discussed above, by dissolving the PVA fibers, hollow air spaces are formed throughout the yarns, corresponding to an increase in the air space in the yarns. By increasing the air space in the yarn, the textile articles formed therefrom are softer and bulkier than textile articles made without the hygro yarns as described herein.

Turning to FIGS. 8A and 8B, removal of the water soluble fibers from the intermediate yarn 160 results in a multi-core yarn 180 having a plurality hollow cores 188*a*, 188*b*. The multi-core yarn 180 extends along a length L that is aligned with a yarn central axis A. As illustrated the multi-core yarn 180 includes a first hollow core 188*a* and a second hollow core 188*b*. The first and second hollow cores 188*a* and 188*b* twist about each other along the length L. Furthermore, the first and second hollow cores 188*a* and 188*b* twist about the central yarn axis A as they extend along the length L.

The first and second hollow cores 188*a* and 188*b* comprise a predefined portion of the yarn 180. The predefined portion may be described in terms of a percentage of yarn cross-sectional dimension (e.g. distance) and/or percentage of a volume of the yarn 180. For instance, the multi-core yarn 180 defines a yarn cross-sectional dimension D1 that is perpendicular to the yarn central axis A. The first hollow core 188*a* can define a first core cross-sectional dimension F1. The second hollow core 188*b* can define a second cross-sectional dimension F2. The yarn cross-sectional dimension D1, the first cross-sectional dimension F1, the second cross-sectional dimension F2 are aligned along the same direction G. As discussed above, the phrase "cross-sectional dimension" is the longest distance across a point of reference in the yarn structure. The cross-sectional dimension may be measured using image analysis techniques, as noted above. In accordance with the illustrated embodiment, each hollow core defines between about 4% to about 20% of the yarn cross-sectional dimension D1. For instance, the combined extent of the first core cross-sectional dimension F1 and the second core cross-sectional dimension F2 is between about 8% to about 40% of the yarn cross-sectional dimension D1 of the multi-core yarn 180. In other words, F1 plus F2 is between about 8% to about 40% of the yarn cross-sectional dimension D1 of the multi-core yarn 180. In one example, the first and second hollow cores 188*a* and 188*b* together define between about 10% to about 30% of the cross-sectional dimension D1. In another example, the first and second hollow cores 188*a* and 188*b* together define between about 15% to about 25% of the yarn cross-sectional dimension D1. The percentages described above correspond to the approximate weight percentage of water soluble fibers in the intermediate yarn 160 before their removal from the yarn.

Similarly, the first and second hollow cores 188*a*, 188*b* comprise a defined volume percentage of the multi-core yarn 180. As described above, the volume percentage is determined assuming that the multi-core yarn 180 is cylindrical. The yarn volume V1 is equal to $\pi(D1/2)^2*h$, where D1 is the yarn cross-sectional dimension D1 defined above and h is a given length L of the yarn 180. The first hollow core volume V2 is equal to $[\pi(F1/2)^2]*h$, where F1 is the cross-sectional dimension F1 of the first hollow core 188*a*. The second hollow core volume V3 is equal to $[\pi(F2/2)^2]*h$, where F2 is the cross-sectional dimension F2 of the second hollow core 188*a*. The volume percentage of the hollow core is equal to [(V2+V3/V1)]*100. In accordance with the illustrated embodiment, the first and second hollow cores 188*a* and 188*b* comprises between about 8% to about 40% of the volume of the multi-core yarn 180. In one example, the first and second hollow cores 188*a* and 188*b* define between about 10% to about 30% of the volume of the multi-core yarn 180. In another example, the first and second hollow cores 188*a* and 188*b* defines between about 15% to about 25% of the volume of the multi-core yarn 180. The volume percentage of the first and second hollow cores 188*a*, 188*b* also correspond to the approximate weight percentage of water soluble fibers in the intermediate yarn 160 before remove of the water soluble fibers.

The multi-core yarn 180 can be twisted to have either a z-twist or a s-twist. Furthermore, the multi-core yarn 180 can be plied into a plied yarn structure. Each yarn in the multi-core yarn in such a plied structure can have a twist direction that is opposite to the twist direction of the multi-core yarn. For instance, if the plied multi-core yarn has a z-twist, each multi-core yarn 180 end will have an s-twist and vice versa.

Figure 9:
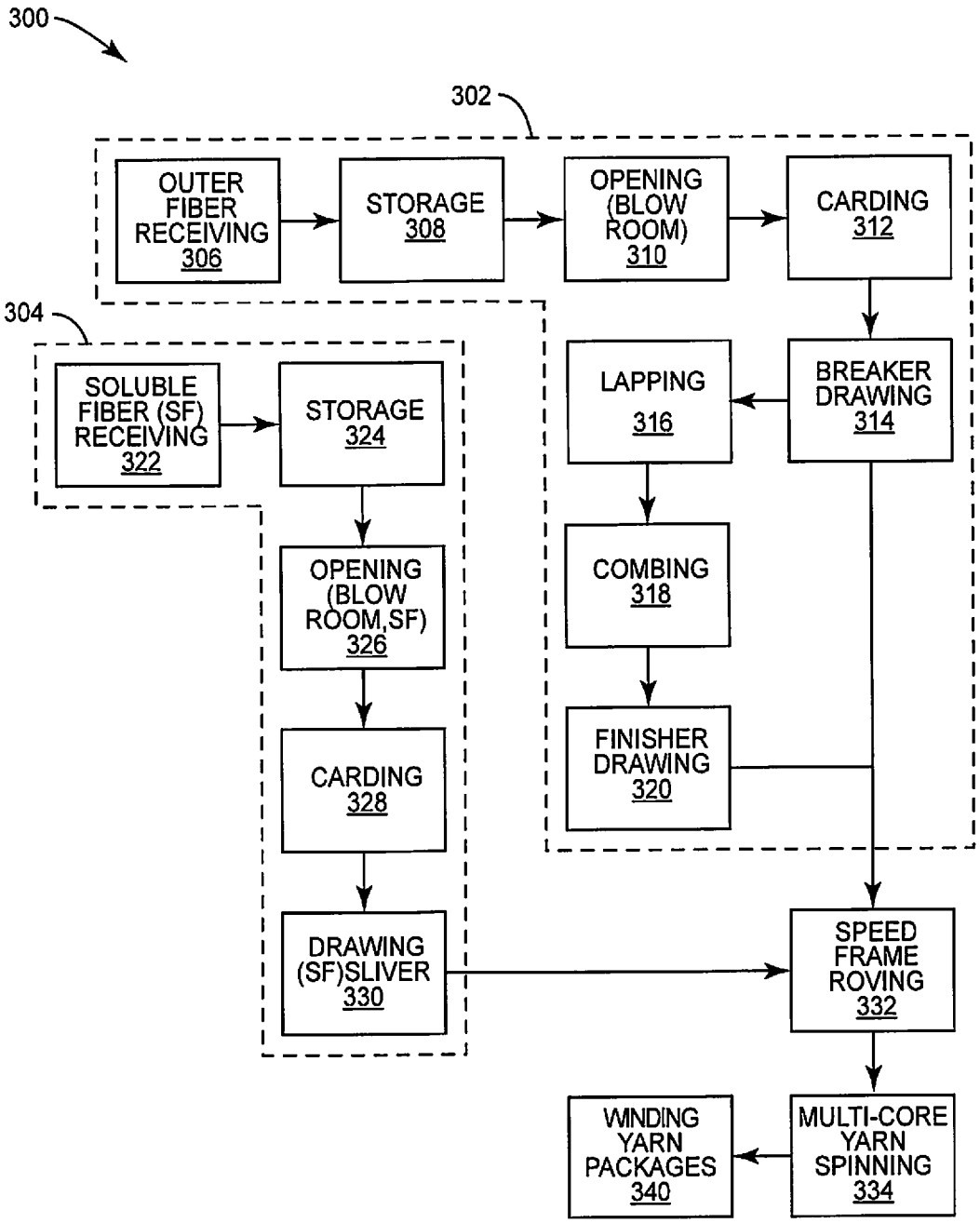
FIG. 9 a process flow diagram for manufacturing the multi-core hygro yarn and related fabrics, according to an embodiment of the present disclosure.
Figure 10:
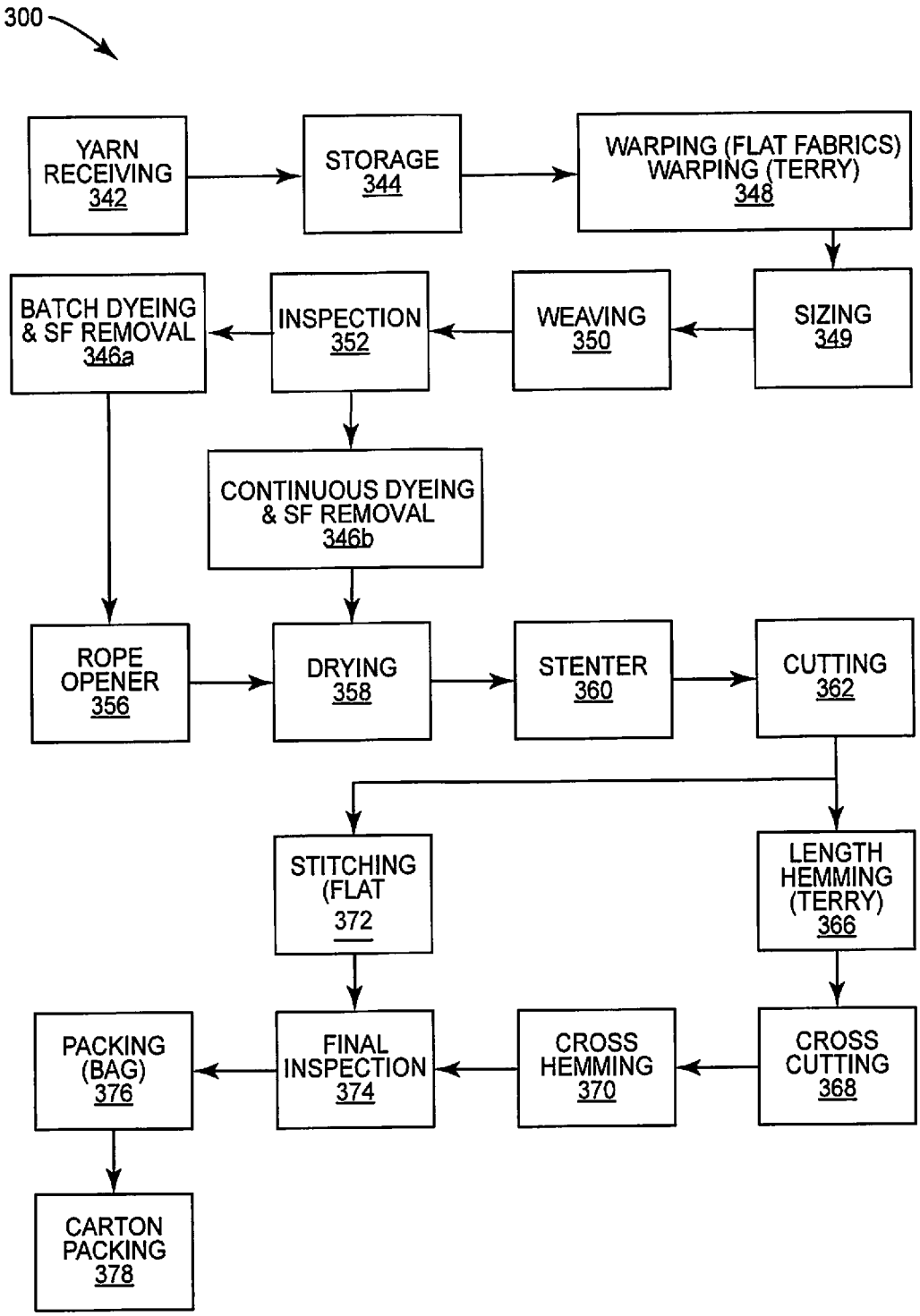
FIG. 10 a process flow diagram for manufacturing textile articles with the multi-core hygro yarns, according to an embodiment of the present disclosure.
Figure 11:
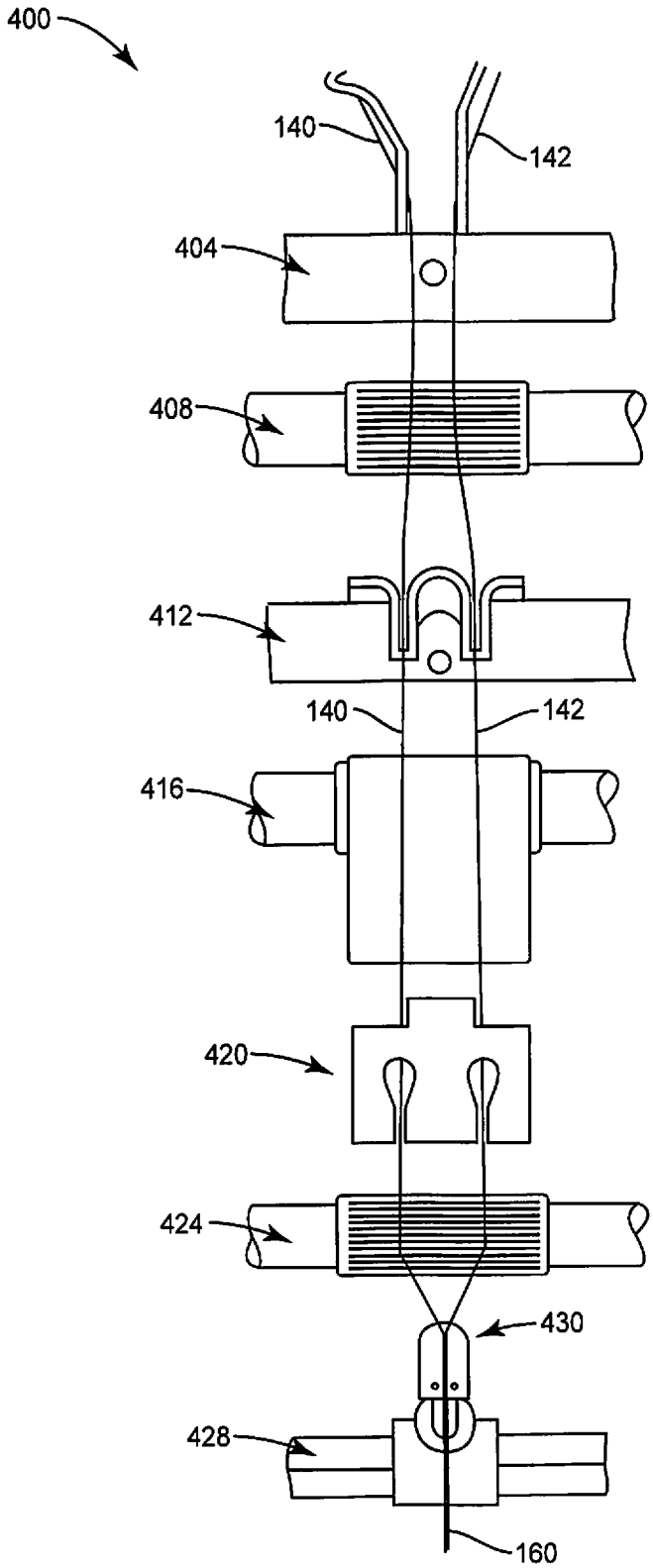
FIG. 11 is schematic of an apparatus using in yarn spinning according to an embodiment of the present disclosure.

Forming the multi-core yarn 180 illustrated in FIGS. 8A-8B into textile articles will be described next. FIGS. 9 and 10 illustrate a method 300 for manufacturing hygro textile articles with the multi-core yarns 180 according to an embodiment of the present disclosure. FIG. 11 illustrates an apparatus 400 used during spinning to help form the multi-core yarn 180. The method 300 described below refers to use of cotton fiber in the outer sheath and of PVA fibers used to form the inner fiber cores 166*a* and 166*b*. However, it should be appreciated that other fibers can be used in the outer sheath and the inner cores, as described above.

The method 300 illustrated includes two preliminary phases: outer sheath sliver formation 302 and soluble fiber sliver formation 304. Outer sheath sliver formation 302 creates slivers used to form the outer sheath of fibers 184 in the intermediate yarn 160 while soluble fiber sliver formation 304 creates slivers used to form the inner cores 166*a* and 166*b* of soluble fibers in the intermediate yarn 160.

Outer sheath fiber formation phase 302 forms slivers of staple fibers for roving. Outer fiber sliver formation initiates with fiber receiving 306 and storage 308. The outer sheath fiber formation phase 302 is similar to the outer sheath formation phase 202 illustrated in FIG. 5. For instance, the outer sheath fibers (or cotton fibers) are subject to an opening step 310 in a blow room. In the blow room, the cotton fibers are processed with a bale plucker, opener, multi-mixer, beater and a dustex machine. After opening 310, the fibers are carded 312 on card machines to deliver card slivers. The sliver from carding is then processed through a breaker drawing step 314 to draw out the slivers. In case of blended slivers, each component is separately processed through carding and the individual carded slivers are subsequently blended together on draw frames. After breaker drawing 314, the slivers can be fed to the speeding frame 332 or inter a lapping step 316 and combing step 318.

For combed yarns, the draw frame slivers are processed via lapping step 216. In lapping, a unilap machine convers doublings into a lap of fibers. The lap is processed in a combing step 318 using a comber. The combed cotton sliver is then passed through another drawing step 320 using a finisher draw frame. The output of the finisher draw frame is fed into the speed frame to make roving for later yarn spinning.

Soluble fiber sliver formation will be described next. Soluble fiber sliver formation phase 304 is substantially similar the soluble fiber formation phase 204 described above and illustrated in FIG. 5. Accordingly, similar soluble fiber configurations, e.g. cut length, denier, etc., as described with respect to the sliver formation phase 204 shown in FIG. 5 are used during the soluble fiber formation phase 304. The soluble fiber formation phase 304 includes a receiving step 322, and a storage step 324. Next, the soluble fibers are subject to an opening step 226 in a blow room in a "cotton" type spinning system. After opening 326, the PVA fibers are conveyed from the blow room to carding 328 to form card slivers, which are coiled into sliver cans. The carded slivers are then further drawn via drawing step 330 to yield the PVA sliver. During the drawing step 330, the carded slivers are passed through one or more draw frames to further orient the fibers. For instance, during drawing 330, the PVA slivers are initially processed with a breaker draw frame and a second pass of drawing uses a finisher draw frame. The output of the drawing 330 are cans of PVA slivers that fed into the roving step 332.

After outer fiber sliver formation 302 and soluble fiber sliver formation 304, the staple fibers (or outer fibers) and soluble fiber slivers are combined during roving 332. Roving 332 is substantially similar to the roving 232 illustrated in FIG. 5 and described above. For example, during roving 332, the soluble fiber sliver is inserted into a middle or central portion of the cotton sliver at a speed frame to yield a single roving 140 (FIG. 11) with a water soluble fiber core. As described above, the speed frame used in the roving step 332 includes an inlet condenser, a middle condenser, a main feed condenser, multiple sets of drafting rollers, and a flyer. The cotton sliver follows a normal path from the back to the front of the speed frame through at least the main feed condenser. The inlet and middle condensers are incorporated for feeding PVA slivers at the inlet, the back and middle drafting zones on the speed frame, to ensure that the PVA sliver stays in the middle of the cotton sliver. The PVA sliver, however, passes through the inlet condenser before occupying the middle portion on the cotton sliver in the main feed condenser, similar to roving step 232 described above. Alternative mechanisms for feeding PVA fiber roving into the path of the cotton roving in the drafting zone of a speed frame can be used as well. In one embodiment, the PVA fibers can be added via core-spinning machine. In another variation, the PVA roving is introduced in the path of cotton roving on the roving machine. Alternatively, the PVA can be added to the middle of the cotton roving by reversing the rotation of flyer in the counter-clock-wise direction, which is opposite the direction of the normal flyer rotation. In both situations, the PVA fibers are placed in the middle of the cotton sliver during the roving process to yield a roving with a core of PVA fibers.

Continuing with FIGS. 9 and 11, a multi-core spinning step 334 converts two rovings 140 and 142 into an intermediate multi-core yarn 160 using an apparatus 400 of a spinning frame. Turning to FIG. 11, the apparatus 400 includes a roving guide 404, rear rollers 408, and pre-drafting zone condensers at the exit side of the rear rollers 408. The apparatus includes a middle roller and apron assembly 416, main drafting zone condense 420, and front rollers 424, and a yarn guide 430. In operation, the roving ends 140 and 142 are fed separately through the drafting zones and converge at the yarn guide 430. Between rollers 428 and yarn guide 430, the ends 140 and 142 are twisted about each other into a single end yarn structure, or intermediate yarn 160. The intermediate yarns 160 exit the rollers 428 and are wound into suitable bobbins. In step 334, subsequent spinning following exit from the apparatus 400 is accomplished using typical settings for forming ring spun yarns. The spinning parameters, however, on the ring frame are set based on the type of fibers in the outer sheath and type and content of the PVA fibers in the inner cores 166*a* and 166*b*. Because the input of the apparatus 400 are two ends 140 and 142 each having a water soluble fiber core, the intermediate yarn 160 exiting will be wound onto the bobbins as a single yarn 160 having first water soluble fiber core 166*a* and a second water soluble fibers core 166*b*, as illustrated in FIGS. 7A and 7B.

The spinning step 334 can produce single end yarns 160 with a count that ranges from about 8 Ne to about 100 Ne. Yarns used for a flat woven fabric 10 (FIGS. 1A & 1B) may have a count that ranges from 10 Ne to about 100 Ne. Yarns used for terry fabrics 110 (FIG. 2) may have a count that ranges from about 8 Ne to about 50 Ne. After yarn spinning 334, the intermediate multi-core yarn 160 can be further packaged 340 into a suitable yarn packages. Alternative, the intermediate multi-core yarn 160 can be plied into a plied yarn configuration as needed.

Turning to FIG. 10, the next phase in the production of hygro textile articles is fabric formation, soluble fiber removal and dyeing, followed by article formation. The multi-core yarn packages formed during packaging 340 are received 342 and stored 344 for warping 348. The warping step 348 includes typical warping operations for flat woven fabrics 10 and/or typical warping operations for terry fabrics 110. For instance, for terry fabrics 110, warping includes both ground yarn warping and pile yarn warping. After warping 348, a sizing step 349 can be used to applying sizing composition to the warp ends.

A weaving step 350 follows sizing 349 and warping 348. The weaving step 350 converts the yarns into woven fabrics. One or more looms, e.g. air-jet or rapier looms, can be use during the weaving step. Each loom may utilize typical shedding mechanism, such as a dobby or jacquard type shedding mechanism. During the weaving step for the woven fabric 10 (FIG. 1A, 1B), the warp and weft yarns can be arranged into a number of different weaving constructions and designs as is known by persons of skill in the art. Furthermore, for woven fabrics 10, the weft yarns, warp yarns, or both the warp and weft yarns can include the plied hygro yarns 180.

Alternatively, during the weaving step for terry fabrics 110, the ground, weft, and pile yarns are woven together using a loom configured for terry production. The terry fabric 110 can be 3-pick, 4-pick, 5-pick, 6-pick, or 7-pick terry. In the one example, the terry fabric 110 is a 3-pick terry. The pile component 150*a*, 150*b* can define a pile height H that extends from the ground component 130 to a top of a pile 154, 154*b* along the thickness direction 8. The pile height can range from about 2.0 to 10 mm. The weaving step 350, for both flat woven fabrics 10 and terry fabrics 110, results in "greige fabrics" that are further processed into textile articles.

After the weaving step 350, the griege fabrics are inspected 352. Following inspection 352, the fabrics can either undergo a batch dyeing and soluble fiber dissolving step 346*a* or a continuous dyeing and fiber dissolving step 356*a*.

The batch dyeing and soluble fiber dissolving step 346*a* includes scouring, bleaching, and dyeing dyed in a typical fashion in a fabric dyeing machine. The operating temperature is maintained in a range from about 95 degrees Celsius to about 120 degrees Celsius. In one example, the temperature is about 120 degrees Celsius, which can help ensure that all the PVA fibers are dissolved in the water. The batch dyeing step 346*a* utilizes a liquor ratio sufficient to facilitate prompt dissolution of the PVA fibers, while allowing free movement of the fabric in the dyeing machine. The liquor ratio may range from about 1:5 to about 1:30. For example, the liquor ratio may be 1:10, 1:12, 1:15, 1:20, 1:25, 1:22, or 1:28.

During step 346*a*, the fabrics are typically wound into the shape of a rope prior to entering the fabric-dyeing machine. The rotation of the fabric in rope form aids in promoting rapid dissolution of the PVA fibers. The dissolution step 346*a* also includes washing and rinsing the fabric. After washing, the liquor is drained and fresh water is injected into the machine for rinsing the fabric to remove all the dissolved PVA from the fabric and machine. During the washing and rinse phase, the water is at a temperature ranging from about 55 degrees Celsius to about 100 degrees Celsius Preferably, the water is at a high temperature, such as 100 degrees Celsius. The fabric can be rinsed in hot water after draining to wash away any PVA residue. After unloading the woven fabrics from the vessel, the water is extracted material in an extractor in the typical manner to reduce the moisture content. Next, an opening step 256 untwists the fabric using a rope opener, similar to the rope opener as described in the 075 patent. Following the rope opening step, a drying step 358 dries the fabric further.

As described above, after the inspection step 352, the griege fabric can processed using continuous dyeing range in a continuous dyeing step 346*b* using similar process temperatures as used in the batch step 346*a*. After the continuous dyeing step 346*b*, the woven fabric is dried 358. The drying step 358 utilizes a hot air dryer to further dry the fabrics at the desired temperature. The dried fabric is expanded to full width and then passed through a stentering step 360. The stentering step 360 can help straighten the fabric.

In certain alternative embodiments for processing terry fabrics, a shearing step is used, whereby both sides of the terry fabric are passed through a shearing machine. The shearing machine has cutting devices, such as blades and/or a laser, which are set such that only protruding fibers are cut and the piles are not cut. The shearing step reduced linting during subsequent washing in use by the consumer.

The result of process 300 is a textile article formed from a woven fabric, such as a flat woven fabric 10 or terry fabric 110, which includes multi-core hygro yarns 180, as illustrated in FIGS. 8A and 8B.

Following the stentering step 360 (or optional shearing step), a cutting step 362 cuts the woven fabrics to the desired length and width depending on the particular end use. Steps 372, 374 and 376 may be used to form textile articles based on a flat woven fabric 10. For flat woven fabrics 10, after cutting 362, the cut woven fabric is stitched 372, inspected 376, and a packaged 376. Packaging step 376 may include folding and packing the textile articles into packages or containers for shipment. Alternatively, after the cutting step 362, processing steps 366, 368, 376 and 378 may be used to form textile articles with terry fabrics 110. For terry fabrics 110, after the cutting step 362, the cut terry fabrics length hemmed 366, cross-cut 368, cross-hemmed 378, inspected 376, and the packaged 376. A carton package step 378 follows to prepare the packages for transport to customers.

The present application includes the following embodiments, each of include the inventive concepts as disclosed herein:

Embodiment 1. A package dyed plied staple yarn that is elongated along a length, the package dyed plied staple yarn comprising:

a first package dyed staple yarn having a first outer sheath of staple fibers twisted together and a first hollow core within the first outer sheath of the staple fibers, wherein the first hollow core extends along the length; and a second package dyed staple yarn having a second outer sheath of staple fibers twisted together and a second hollow core within the first outer sheath of the staple fibers, wherein the second hollow core extends along the length, wherein the first packaged dyed staple yarn and the second package dyed staple yarn are twisted around each other and about a yarn central axis that is aligned with the length of the plied staple yarn.

Embodiment 2. The package dyed plied staple yarn of embodiment 1, wherein each package dyed staple yarn includes color agents disposed in each of the staple fibers.

Embodiment 3. The package dyed plied staple yarn of embodiment 1, wherein each package dyed staple yarn is a single end staple yarn.

Embodiment 4. The package dyed plied staple yarn of embodiment 1, wherein the staple fibers include a) cotton fibers, or b) cotton fiber and blends of one or more other fibers.

Embodiment 5. The package dyed plied staple yarn of embodiment 1, wherein the first and second hollow cores each include water soluble fibers.

Embodiment 6. The package dyed plied staple yarn of embodiment 1, wherein the water soluble fibers are polyvinyl alcohol fibers.

Embodiment 7. The package dyed plied staple yarn of embodiment 1, wherein each of the package dyed staple yarn is a ring-spun yarn.

Embodiment 8. A cross-wound package of the plied staple yarn of embodiment 1, wherein the first and second hollow cores each include water soluble fibers.

Embodiment 9. The cross-wound package of embodiment 8, wherein the water soluble fibers are polyvinyl alcohol fibers.

Embodiment 10. A process for manufacturing a textile structure, comprising:

spinning a first staple yarn to include a first outer sheath of staple fibers twisted around a first inner core of water soluble fibers;

spinning a second staple yarn to include a second outer sheath of staple fibers twisted around a second inner core of water soluble fibers;

plying the first staple yarn and the second staple into a plied staple yarn; and winding the plied staple yarn into a yarn package; and with the plied staple yarn on the yarn package, removing the first and second inner core of the water soluble fibers from each one of the first and second staple yarns in the plied staple yarn to form first and second hollow cores in the first and second staple yarns, respectively, thereby forming a plied packaged dyed staple yarn.

Embodiment 11. The process of embodiment 10, wherein the plying step includes twisting a third staple yarn with the first and second staple yarns into a three-ply staple yarn.

Embodiment 12. The process of embodiment 10, wherein the removing step includes dyeing the plied staple yarns.

Embodiment 13. The process of embodiment 12, wherein the dyeing step includes package dyeing multiple yarn packages that include the plied staple yarns.

Embodiment 14. The process of embodiment 10, wherein the removing step exposes the staple yarns to water at a temperature between about 50 degree Celsius and about 110 degree Celsius to dissolve the water soluble fibers.

Embodiment 15. The process of embodiment 10, wherein the first spinning step further comprises:

forming a first sliver of water soluble fibers;

forming a first sliver of staple fibers;

guiding the first sliver of water soluble fibers into a central portion of the first sliver of staple fibers to form a first roving of staple fibers that surround the water soluble fibers; and twisting the first roving into the staple yarn on a spinning frame.

Embodiment 16. The process of embodiment 15, wherein the second spinning step further comprises:

forming a second sliver of water soluble fibers;

forming a second sliver of staple fibers;

guiding the second sliver of water soluble fibers into a central portion of the second sliver of staple fibers to form a second roving of staple fibers that surround the water soluble fibers; and twisting the second roving into the second staple yarn on a spinning frame.

Embodiment 17. The process of embodiment 10, after the removing step, weaving a plurality of the plied staple yarns into a fabric.

Embodiment 18. The process of embodiment 10, wherein the weaving step is weaving a flat fabric or weaving a terry fabric.

Embodiment 19. A spun staple yarn that is elongated along a length, the spun staple yarn comprising:

an elongated assembly of staple fibers that are twisted about a yarn central axis that extends along the length, the elongated assembly of staple fibers including a first hollow core that extends along the length, and a second hollow core that extends along the length, wherein the first hollow core and the second hollow core twist around the yarn central axis and with respect to each other as each hollow core extends along the length.

Embodiment 20. The spun staple yarn of embodiment 19, wherein the staple fibers include a) cotton fibers, or b) cotton fiber and blends of one or more other fibers.

Embodiment 21. The spun staple yarn of embodiment 19, wherein the first and second hollow cores each include water soluble fibers.

Embodiment 22. The spun staple yarn of embodiment 12, wherein the water soluble fibers are polyvinyl alcohol fibers.

Embodiment 23. The spun staple yarn of embodiment 19, wherein the elongated assembly of staple fibers and the first and second hollow cores have the same twist direction.

Embodiment 24. The spun staple yarn of embodiment 19, wherein the elongate assembly of staple fibers is a ring-9 spun yarn.

Embodiment 25. A cross-wound package of the plied staple yarn of embodiment 24, wherein the first and second hollow cores each include water soluble fibers.

Embodiment 26. The cross-wound package of embodiment 25, wherein the water soluble fibers are polyvinyl alcohol fibers.

Embodiment 27. A process for manufacturing a multi-core staple yarn, comprising:

spinning staple yarns to include an outer sheath of staple fibers twisted around a first core of water soluble fibers and a second core of water soluble fibers; and removing the first and second cores of water soluble fibers from each one of the staple yarns to form a multi-core staple yarn.

Embodiment 28. The process of embodiment 27, wherein the removing step includes dyeing the staple yarns.

Embodiment 29. The process of embodiment 27, wherein the dyeing step includes package dyeing the staple yarns.

Embodiment 30. The process of embodiment 27, wherein the removing step exposes the staple yarns to water at a temperature between about 50 degree Celsius and about 110 degree Celsius to dissolve the water soluble fibers.

Embodiment 31. The process of embodiment 27, wherein spinning includes spinning a first roving and a second roving into the single one of the staple yarns on a spinning frame, wherein the first and second rovings each include an outer sheath of staple fibers that surround an inner core of the water soluble fibers.

Embodiment 32. The process of embodiment 27, wherein the spinning step includes:

guiding a first sliver of water soluble fibers into a first central portion of a first sliver of staple fibers to form the first roving; and guiding a second sliver of water soluble fibers into a second central portion of a second sliver of staple fibers to form the second roving.

Embodiment 33. The process of embodiment 27, wherein the spinning step includes twisting the first roving and the second roving into the staple yarn on the spinning frame.

Embodiment 34. The process of embodiment 27, wherein the spinning step further comprises:

forming a sliver of water soluble fibers;

forming a sliver of staple fibers;

guiding the sliver of water soluble fibers into a central portion of the sliver of staple fibers to form a roving of staple fibers that surround the water soluble fibers; and twisting the roving into the staple yarn on a spinning frame.

Embodiment 35. The process of embodiment 34, wherein the roving is a first roving, and the spinning step includes spinning a first roving and a second roving into the single one of the staple yarns on a spinning frame.

While the disclosure is described herein using a limited number of embodiments, these specific embodiments are not intended to limit the scope of the disclosure as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired.

What is claimed:

1. A spun staple yarn that is elongated along a length, the spun staple yarn comprising:

a single ply ring spun yarn consisting essentially of an outer sheath of cotton staple fibers that are twisted about a yarn central axis that extends along the length, the single ply yarn defining a first open space that extends along an entirety of the length, and a separate, second open space that extends along the entirety of the length, wherein the first open space and the second open space twist around the yarn central axis and with respect to each other along the entirety of the length of the single ply ring spun yarn, wherein the outer sheath of cotton staple fibers and the first and second open spaces have the same twist direction, wherein the single ply ring spun yarn has a yarn cross-sectional dimension that is perpendicular to the yarn central axis, wherein the first open space and the second open space each define an open space cross-sectional dimension that is perpendicular to the yarn central axis, wherein a combined open space cross-sectional dimension is between 10% to 30% of the yarn cross-sectional dimension, wherein the single ply ring spun yarn has a count between 8 Ne to 50 Ne, wherein the single ply ring spun yarn is absorbent, hydrophilic, and adapted for use in home textile articles.

2. The spun staple yarn of claim 1, wherein the first and second open spaces are formed by dissolving water soluble fibers.

3. The spun staple yarn of claim 2, wherein the single ply ring spun yarn is formed by the cotton staple fibers and the water soluble fibers having the same twist direction.

* * * * *